US006745531B1

(12) United States Patent
Egan

(10) Patent No.: US 6,745,531 B1
(45) Date of Patent: Jun. 8, 2004

(54) PRESSURE EQUALIZED COMPARTMENT FOR EXTERIOR INSULATION AND FINISH SYSTEM

(75) Inventor: William F. Egan, Ponte Vedra Beach, FL (US)

(73) Assignee: Construction Research & Technology GmbH, Trostberg (DE)

( * ) Notice: Subject to any disclaimer, the term of this patent is extended or adjusted under 35 U.S.C. 154(b) by 0 days.

(21) Appl. No.: 09/918,664

(22) Filed: Jul. 31, 2001

Related U.S. Application Data

(60) Provisional application No. 60/221,764, filed on Jul. 31, 2000.

(51) Int. Cl.[7] ..... E04B 1/70; E04F 17/00; E04F 17/04; E04F 17/08

(52) U.S. Cl. ..... 52/302.1; 52/408; 52/508; 52/506.1

(58) Field of Search ..... 52/302, 302.1, 52/408, 508, 506.01, 281

(56) References Cited

U.S. PATENT DOCUMENTS

| | | | | |
|---|---|---|---|---|
| 2,214,183 A | | 9/1940 | Seymour | |
| 3,031,044 A | * | 4/1962 | Stitt et al. | 52/508 |
| 3,318,056 A | * | 5/1967 | Thompson | 52/105 |
| 3,687,759 A | | 8/1972 | Werner et al. | |
| 3,691,004 A | | 9/1972 | Werner et al. | |
| 3,949,657 A | | 4/1976 | Sells | |
| 3,998,016 A | * | 12/1976 | Ting | 52/323 |
| 4,024,719 A | | 5/1977 | Risseeuw | |
| 4,212,692 A | | 7/1980 | Rasen et al. | |
| 4,315,392 A | | 2/1982 | Sylvest | |
| 4,434,592 A | * | 3/1984 | Reneault et al. | 52/145 |
| 4,467,580 A | * | 8/1984 | Sowinski | 52/302.1 |
| 4,646,498 A | * | 3/1987 | Schneller et al. | 52/309.12 |
| 4,658,552 A | | 4/1987 | Mulford | |
| 4,815,963 A | | 3/1989 | Berkhout | |
| 4,840,515 A | | 6/1989 | Freese | |
| 4,922,676 A | | 5/1990 | Spronken | |
| 4,942,699 A | | 7/1990 | Spinelli | |
| 4,943,185 A | | 7/1990 | McGuckin et al. | |
| 4,946,310 A | | 8/1990 | Wunderatzke | |
| 5,027,572 A | * | 7/1991 | Purcell et al. | 52/309.9 |

(List continued on next page.)

OTHER PUBLICATIONS

Infinity® System Specifications (DS136). A Pressure–Equalized Rainscreen Exterior Insulation and Finish System. Dryvit Systems, Inc., 1997.

STO® Plus 1 RS Pressure Equalizing Rainscreen EIFS. Design Guide, Jan. 1, 1997.

*Primary Examiner*—Carl D. Friedman
*Assistant Examiner*—Nahid Amiri
(74) *Attorney, Agent, or Firm*—Renner, Kenner, Greive, Bobak, Taylor & Weber

(57) ABSTRACT

The present invention provides a pressure equalizing compartment for building structures comprising: an inner member having oppositely facing inner and outer surfaces and having a top and bottom edge; spaced closure members contacting said outer surface of said inner member and extending vertically on the surface of the inner member, a horizontally disposed closure member disposed on the outer surface of the inner member, a space being defined between said spaced, closure members; a cavity forming means disposed in said space between said closure members; an outer member having oppositely facing inner and outer surfaces disposed substantially over said cavity forming means to form a pressure equalizing compartment, wherein the compartment having an air and moisture vent communicating to the outside environment. The present invention also provides exterior insulation and finish systems and building walls incorporating the pressure equalizing compartments and methods of installation.

59 Claims, 5 Drawing Sheets

U.S. PATENT DOCUMENTS 5,099,627 A 3/1992 Coulton et al.
5,218,798 A 6/1993 Bentivegna et al.
5,230,189 A 7/1993 Sourlis
5,230,192 A 7/1993 Webb et al.
5,287,673 A 2/1994 Kreikemeier
5,363,621 A 11/1994 Kroll et al.
5,392,578 A 2/1995 Kroll et al.
5,410,852 A * 5/1995 Edgar et al. ..... 52/408
5,440,854 A * 8/1995 Hohmann ..... 52/489.1
5,481,838 A 1/1996 Fishel et al.
5,598,673 A 2/1997 Atkins
5,826,388 A 10/1998 Irving
5,960,595 A 10/1999 McCorsley, III et al.
6,226,947 B1 * 5/2001 Bado et al. ..... 52/483.1
6,279,284 B1 * 8/2001 Moras ..... 52/408
6,355,333 B1 * 3/2002 Waggoner et al. ..... 52/408
6,550,212 B2 * 4/2003 Lubker, II ..... 52/741.13

* cited by examiner

PRESSURE EQUALIZED COMPARTMENT FOR EXTERIOR INSULATION AND FINISH SYSTEM

This application claims the benefit of provisional application No. 60/221,764, filed Jul. 31, 2000.

TECHNICAL FIELD OF THE INVENTION

The invention relates generally to an improved pressure equalized external insulation and finish system used in the building and construction industry. More particularly, the invention relates to an improved pressure equalized external insulation and finish system that additionally provides a cavity or compartment to equalize the pressure differential between the interior sheathing of a building structure and the outside environment, and to facilitate the drainage of water from the internal portions of building structures.

BACKGROUND OF THE INVENTION

Modern techniques for constructing the walls of buildings may take numerous forms. Among these is two-by-four (2×4) framed construction. As is well known in the relevant art, conventional 2×4 wall construction begins with framing of the walls with wood or steel members. These wood or steel members typically have nominal dimensions of 2"×4" and are, therefore, called "two-by-four" or 2×4. These 2×4s are oriented vertically and spaced at intervals generally either 16" or 24" and are each connected at the top and bottom to similar members horizontally oriented. This structure is referred to in the relevant art as a "framed" wall.

Traditionally, a sheet of sheathing such as plywood or other material is then often applied to the exterior of the framed wall, but may not be required in all circumstances. Such requirements are typically established by governmental building codes. A weather barrier may then be applied to the exterior of the sheathing, with an external wall covering then being applied directly over the air/weather barrier.

Any one of numerous materials may be used for the external wall covering of building structures such as brick, stucco, vinyl or aluminum siding, wood, exterior insulation and finish systems (EIFS), and the like. A sheet of gypsum board or drywall is typically applied to the interior surface of the framed wall toward the living area.

When completed, the building structure is designed to prevent the flow of water and moisture from the external environment into the building structure. If a breach or void, such as openings or cracks exist in the exterior finish, then wind loads can potentially act as the driving mechanism to force water through the cracks or openings in the exterior finish, a condition which is to be avoided.

If any such water or moisture should penetrate the exterior finish, the air/weather barrier mentioned above serves as an additional obstacle to the intrusion of such water or other elements onto the sheathing material and into the wall. If water is permitted to flow through the air/weather barrier and onto the sheathing material, the water will typically remain trapped between the air/weather barrier and the sheathing material, which may result in speedy deterioration of the sheathing material, thus requiring replacement.

Moreover, moisture from the environment may become trapped between the exterior finish and the air/weather barrier. In this circumstance, if the, air/weather barrier contains significant voids, cuts, gaps, etc., whether incurred during construction or due to settling of the structure, any such moisture may find its way through the opening in the air/weather barrier, onto the sheathing material, and eventually into the wall with the deleterious effects described above. Additionally, such water can freeze during the winter months resulting in freeze-thaw cycle-related damage to the structure. Moreover, such trapped moisture can reduce the wall system components' serviceability and service life. Thus, it is desired, as much as possible, to eliminate moisture entrapment between the exterior wall covering and the air/weather barrier and to prevent the formation of breaches in the air/weather barrier.

There have been several attempts in the prior art to overcome the problem of water or moisture intrusion into the exterior wall covering from the outside environment.

For example, U.S. Pat. No. 5,410,852 to Edgar et al. provides an exterior insulation and finish system for building structures comprising an air barrier, an air-permeable insulation layer, and an exterior finish. The air-permeable insulation layer is disposed between the air barrier and the exterior finish. A portion of the air-permeable insulation layer is exposed to permit air to flow into and out of the insulation layer to equalize the pressure across the exterior finish. It is taught that a significant pressure differential across the exterior finish will not exist and, therefore, no water will be forced through the exterior finish into the insulation.

U.S. Pat. Nos. 5,363,621 and 5,392,578 both to Kroll et al., provide an insulative wall cladding system having a plurality of interconnecting air pressure and moisture vent channels. The pressure and moisture vent channels are created by placing a plurality of insulation boards having 45 degree angle edges in adjacent contact to each other. As a consequence of the adjacent relationship with the other insulation boards, the plurality of channels inter-connect with each other and, via a lower vent, communicate with the outside atmosphere. The interconnecting channels prevent the formation of an air pressure differential between the outside atmosphere and the inside atmosphere in a cavity of the cladding.

Although the pressure equalized systems of the prior art described hereinabove, provide a means to equalize pressure across the exterior finish, none of the references provide for compartments or cavities between the building substrate or air/weather barrier-coated building substrate and the exterior finish, which equalize the pressure across the exterior finish. Therefore, there still remains a great need in the art for improved pressure equalized exterior wall systems.

SUMMARY OF THE INVENTION

It is, therefore, an object of the present invention to provide an exterior insulation and finish system incorporating a pressure equalizing cavity or compartment.

It is also an object of the present invention to provide an exterior insulation and finish system incorporating a water and moisture drainage cavity.

It is another object of the present invention to provide a process for the installation of an exterior insulation and finish system incorporating a pressure equalizing and a water and moisture drainage cavity.

These and other objects, which shall become apparent from the specification which follows, are accomplished by the invention as hereinafter described and claimed.

The present invention, therefore, provides a pressure equalizing compartment for building structures comprising: an inner member having oppositely facing inner and outer surfaces and having a top and bottom edge, said outer surface substantially uniformly coated with an air/weather barrier; a closure member horizontally disposed on a portion said outer surface of said inner member; spaced apart closure members contacting said outer surface of said coated inner member and extending vertically along said inner member and in contact with a portion of said horizontally disposed closure member, a space being defined between said spaced closure members and said horizontally disposed closure member; a cavity forming means disposed in said space defined by said closure members, and substantially contacting said air/weather barrier; and an outer member having oppositely facing inner and outer surfaces disposed substantially over said cavity forming means within said space defined by said closure members to form a compartment; wherein said compartment having an air and moisture vent communicating to the outside environment.

The present invention also provides a pressure equalizing exterior insulation and finish for building structures comprising: at least one pressure equalizing compartment comprising: an inner member having oppositely facing inner and outer surfaces and having a top and bottom edge, said outer surface substantially uniformly coated with an air/weather barrier; a closure member horizontally disposed on a portion said outer surface of said inner member; spaced apart closure members contacting said outer surface of said coated inner member and extending vertically along said inner member and in contact with a portion of said horizontally disposed closure member, a space being defined between said spaced closure members and said horizontally disposed closure member; a cavity forming means disposed in said space defined by said closure members, and substantially contacting said air/weather barrier; and an outer member having oppositely facing inner and outer surfaces disposed substantially over said cavity forming means within said space defined by said closure members to form a compartment; wherein said compartment has an air and moisture vent communicating to the outside environment; and an exterior finish applied to said outer surface of said outer member.

The present invention also provides a pressure equalized building wall comprising: a substrate having oppositely facing inner and outer surfaces and having top and bottom edges; and at least one pressure equalizing compartment, said compartment comprising: an air/weather barrier having opposite facing inner and outer surfaces, wherein said inner surfaces is in contact with said outer surface of said substrate; a closure member horizontally disposed on a portion said outer surface of said inner member; spaced apart closure members contacting said outer surface of said coated inner member and extending vertically along said inner member and in contact with a portion of said horizontally disposed closure member, a space being defined between said at least two spaced closure members and said horizontally disposed closure member; a cavity forming means disposed in said space defined by said closure members, and substantially contacting said air/weather barrier; and an outer member having oppositely facing inner and outer surfaces disposed substantially over said cavity forming means within said space defined by said closure members to form a compartment; and wherein said compartment has an air and moisture vent communicating to the outside environment.

In another embodiment, the pressure equalized building wall further comprises an exterior finish applied to said outer surface of said outer member.

The present invention further provides a process for installing a pressure equalized building wall comprising: providing an inner member having an upper edge and lower edge and oppositely facing inner and outer surfaces; applying an air/weather barrier substantially uniformly over the outer surface of said inner member; attaching a closure member on said outer surface of said inner member in a substantially horizontal direction; attaching spaced apart closure members to said outer surface of said inner member, wherein said spaced apart closure members are extending vertically along said inner member and in contact with a portion of said horizontally disposed closure member, a space being defined between said spaced closure members and said horizontally disposed closure member; disposing a cavity forming means on the outer surface of the air/weather barrier within the spaced defined between said closure members; and disposing an outer member having an inner surface and an outer surface substantially over the cavity forming means within the space between said closure members.

In another embodiment, the process for installing a pressure equalized building wall further comprises applying an exterior finish to the outer surface of the outer member.

DETAILED DESCRIPTION OF THE INVENTION

Figure 1:
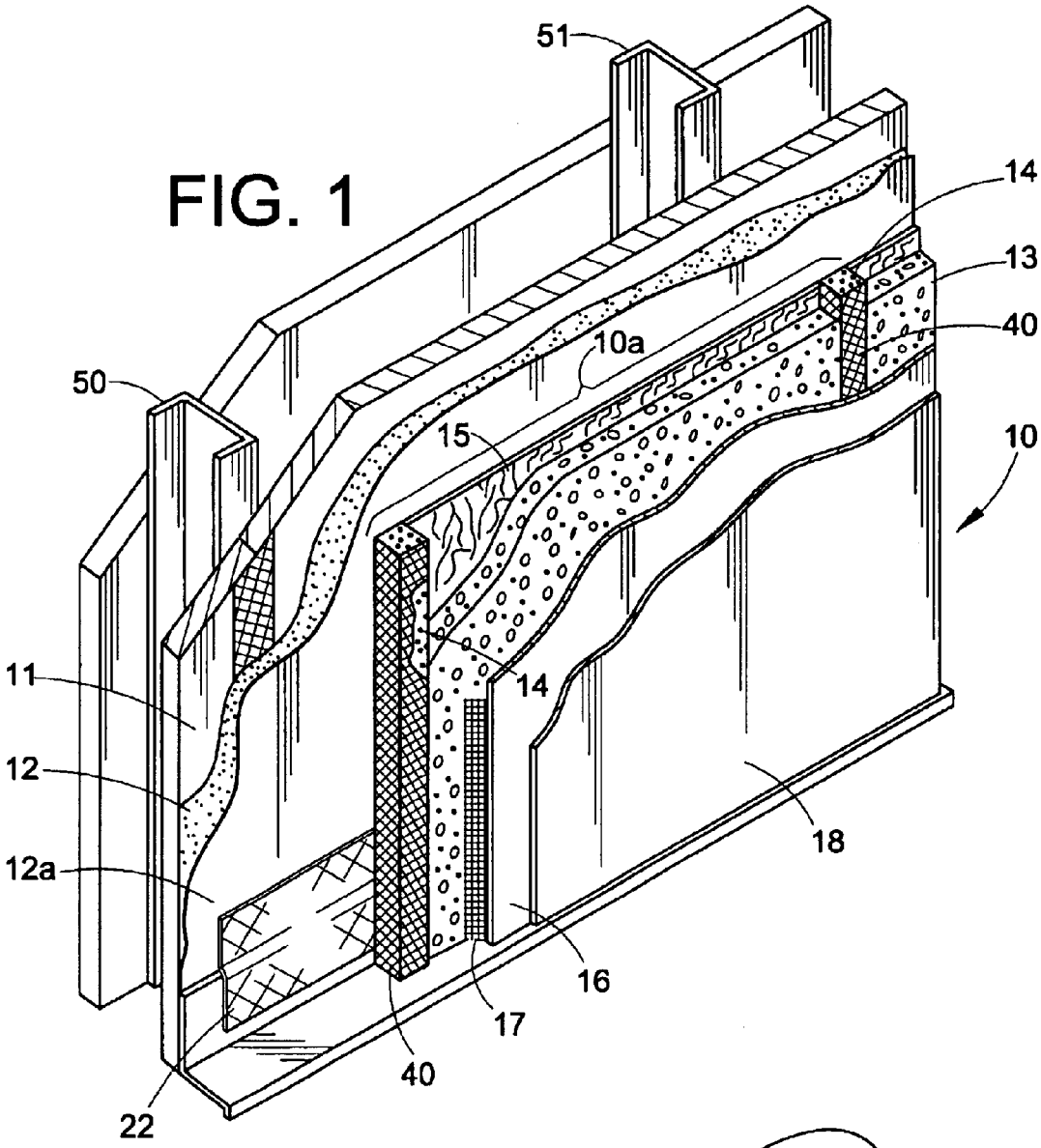
FIG. 1 is a cut away perspective view of the pressure equalized exterior insulation and finish system of the present invention showing the supporting sheathing and framing.

The present invention provides pressure equalizing and drainage compartments for building structures. The present invention also provides an exterior insulation and finish system for application to the exterior surface of a building wall. Unlike exterior insulation and finish systems known in the prior art, the exterior insulation and finish system of the present invention includes a pressure equalizing compartment and drainage cavity.

The pressure equalizing compartment of the present invention includes an exterior surface for primary weather protection and aesthetic appearance and a continuous inner secondary weather barrier separated by a vented compartment or cavity having an air space. The cavity allows for the air pressure in the air space and the air pressure exterior to the wall to be equalized, thereby minimizing the effect of pressure differential induced water and moisture penetration into the exterior finish.

In general, the pressure equalizing exterior insulation and finish system of the present invention includes at least one pressure equalizing compartment. Each compartment of the pressure equalizing system comprises an inner member having oppositely directed or oppositely facing inner and outer surfaces. The inner member also has top and bottom edges.

The inner member or substrate can be plywood, wafer board, particle board, cement board, gypsum board, concrete block and masonry block. In one preferred embodiment, the inner member of the pressure equalizing compartment is gypsum board or gypsum sheathing. In another preferred embodiment, the inner member is a sheet of plywood.

The outer surface of the inner member of the pressure equalizing system of the present invention is substantially uniformly coated with a secondary air/weather barrier. The secondary air/weather barrier preferably is a mixture of an acrylic-based polymer, portland cement and water. Preferably, the air/weather barrier is about a 1:1 mixture by weight of acrylic-based polymer to portland cement, with water added if necessary. The weather barrier is applied substantially uniformly over the substantially entire outer surface the inner member of the pressure equalizing compartment with a trowel or similar mechanical device. The secondary air/weather barrier reduces air infiltration and provides additional moisture protection to the inner member, which is preferably a sheathing material.

The pressure equalizing compartment also includes spaced apart closure members, also referred to as "closure blocks." The closure members are applied to or otherwise mounted on the outer surface of the inner member of the pressure equalizing compartment. The spaced apart closure blocks are arranged on the outer surface of the inner member in a substantially vertical manner. The closure members are applied to the outer surface of the inner member of the compartment and may extend vertically along substantially the entire length from the upper to the lower edge of the outer surface of the inner member or members. Although the spaced apart closure members may extend vertically substantially from the top edge to the bottom edge of the inner member, it is not required to provide adequate pressure equalization and drainage.

At least one additional closure member is disposed on the outer surface of the inner member in a substantially horizontal fashion. In one embodiment, the additional closure member is disposed horizontally along the upper or top edge of the coated outer surface of the inner member of the compartment. According to this embodiment, the horizontally disposed closure member extends substantially along the entire length of the top edge of the inner member or members. However, the horizontally disposed closure member does not need to be located at the top or upper edge of the inner member, but can be placed in a horizontal fashion at any distance from the upper or lower edges of the inner member.

In one preferred embodiment, the closure members are applied to the outer surface of the inner member by means of an adhesive material. A suitable adhesive composition comprises from about 10 to about 15 weight percent acrylic polymer, from about 45 to about 50 weight percent silica and from about 30 to about 35 weight percent water. This type of adhesive material provides a durable bond between the coated outer surface of the inner member and the surface of the closure member in contact with the inner member.

An end portion of the spaced apart and vertically disposed closure members contact a portion of the horizontally disposed closure members. As such, a space or compartment is defined between vertically disposed closure members along the inner member. A cavity forming means is disposed in the space between the closure members. In accordance with the features of the present invention, the cavity forming means is mat comprising an open, three-dimensional matrix of filaments which have been laid in overlapping rows of irregularly looped and intermingled fashion and are self-bonded at random points of intersection.

The mat is preferably manufactured from a polymeric material. A particularly well-suited polymeric material that can be used to manufacture the mat includes a thermoplastic polyamide resin such as Nylon 6, although other materials may be used without departing from the spirit of the present invention. Such other materials that can be used to manufacture mat include, but are not limited to, polyolefin fibers, such as polypropylene, high density polyethylene, polyvinylchloride, polystyrene fibers and polyester fibers.

The polymeric mat is preferably of a type described and manufactured in accordance with U.S. Pat. Nos. 4,212,692, 3,691,004, and/or 3,687,759, which are all incorporated by reference, although other configurations are possible.

As is known and understood in the relevant art, the filaments of the polymeric mat form a peak and valley structure undulating in the longitudinal and/or transverse directions, preferably to provide a waffle-like structure. Due to its filamentatious structure, the polymeric mat contains a great number of mutually interconnected voids which allow gases and liquids to flow freely therethrough.

The polymeric mat has a crush resistance allowing it to withstand a level of compressive load without crushing the peak and valley configuration thereof. Thus, air and water can still flow directly and transversely through the mat, even when the mat is under a compressive load. The ability of the mat to withstand a given compressive load must necessarily vary with factors such as the filament diameter, the material of which the mat is composed, the extent to which self-bonding has occurred, the height of the peaks and valleys, as well as a plurality of other such variables. Thus, the crush-resistant properties of the mat, while inherent in the design of the mat, vary with numerous parameters regarding the construction of the mat.

The pressure equalizing compartment of the present invention also includes an outer member having oppositely facing or directed inner and outer surfaces. The outer member is disposed substantially over the cavity forming means, within the space defined by the closure members. The outer member is a polymeric sheet material. Preferably, the outer member is a polymeric insulation board. Although the insulation board may be comprised of many different materials, it is preferably comprised of expanded polystyrene.

The pressure equalizing system is constructed such each compartment has an air and moisture vent that communicates to the outside environment.

With reference to FIG. 1, a pressure equalizing exterior insulation and finish system 10 constructed in accordance with the present invention is shown. The pressure equalizing system 10 includes at least one compartment 10*a* comprising a inner member 11 coated with an air/weather barrier 12, an outer member 13, closure members 14, and a cavity forming means 15.

Still referring to FIG. 1, an exterior insulation and finish system including the pressure equalizing compartment also comprises an exterior finish. The exterior finish includes a base coat 16, a reinforcing mesh 17 and a finish coat 18.

Figure 2:
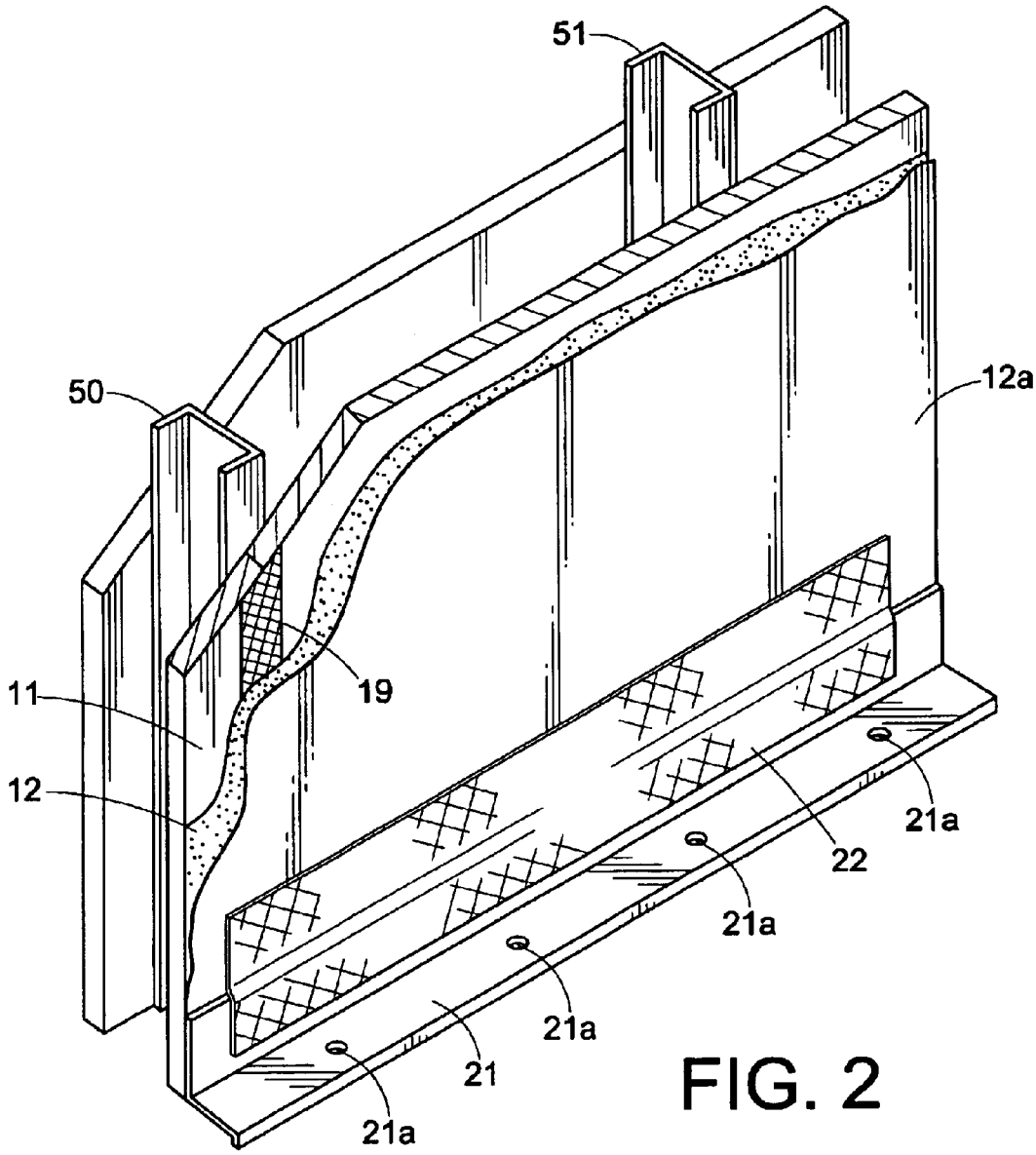
FIG. 2 is a cut away perspective view of a typical framed wall with sheathing that is coated with an air/weather barrier and showing a starter track mounted on the air/weather barrier.

With reference to FIG. 2, an exterior insulation and finish system 10 is shown assembled. Joints along the inner member or substrate 11 may be easily sealed by means of a sealing mesh 19. The sealing mesh 19 is preferably self-adhering and is reinforced with open weave glass fibers. An air/weather barrier 12 that is compatible with the inner member 11 is applied over the inner member 11 and sealing mesh 19. In one embodiment, an additional secondary weather barrier 12*a*, such as building paper or polymeric secondary weather barriers, may be applied over the trowel-applied air/weather.

Although a pre-formed weather barrier may be utilized in the present invention, preferably, the air/weather barrier 12 is a roller-, brush- or trowel-applied material as described hereinabove. In one embodiment, before the air/weather barrier 12 has been applied to the outer surface of the inner member 11 of the pressure equalizing system 10 of the present invention, a starter track 21 may be mounted onto the bottom edge of the outer surface of the inner member 11. The air/weather barrier 12 is applied over the outer surface of the inner member 11 and over the starter track 21, and a plurality of closure members are the applied over the air/weather barrier 12 to form a compartment. In an alternative embodiment, the starter track 21 may be mounted adjacent to the outer surface of the inner member 11 of the system, with the air/weather barrier12 being applied over the starter track 21 and inner member 11.

The starter track 21 is preferably a rigid L-shaped structure, formed of a non-corrosive material, such as aluminum or UV-resistant polyvinyl chloride. The starter track 21 is mounted onto the inner member 11 of the system 10 in a position that is substantially parallel to the foundation of the building structure. The starter track 21 is preferably mounted along the base of the inner member 11 of the system and extends along substantially the entire length of the inner member 11 of the system 10. Preferably, the starter track 21 is applied or mounted onto the inner member 11 by means of a sealing membrane 22. The sealing membrane 22 may be a composite membrane or a trowel-applied membrane. Preferably, the self-adhering membrane is a composite membrane comprising a rubberized asphalt layer and a polyester layer.

Figure 3:
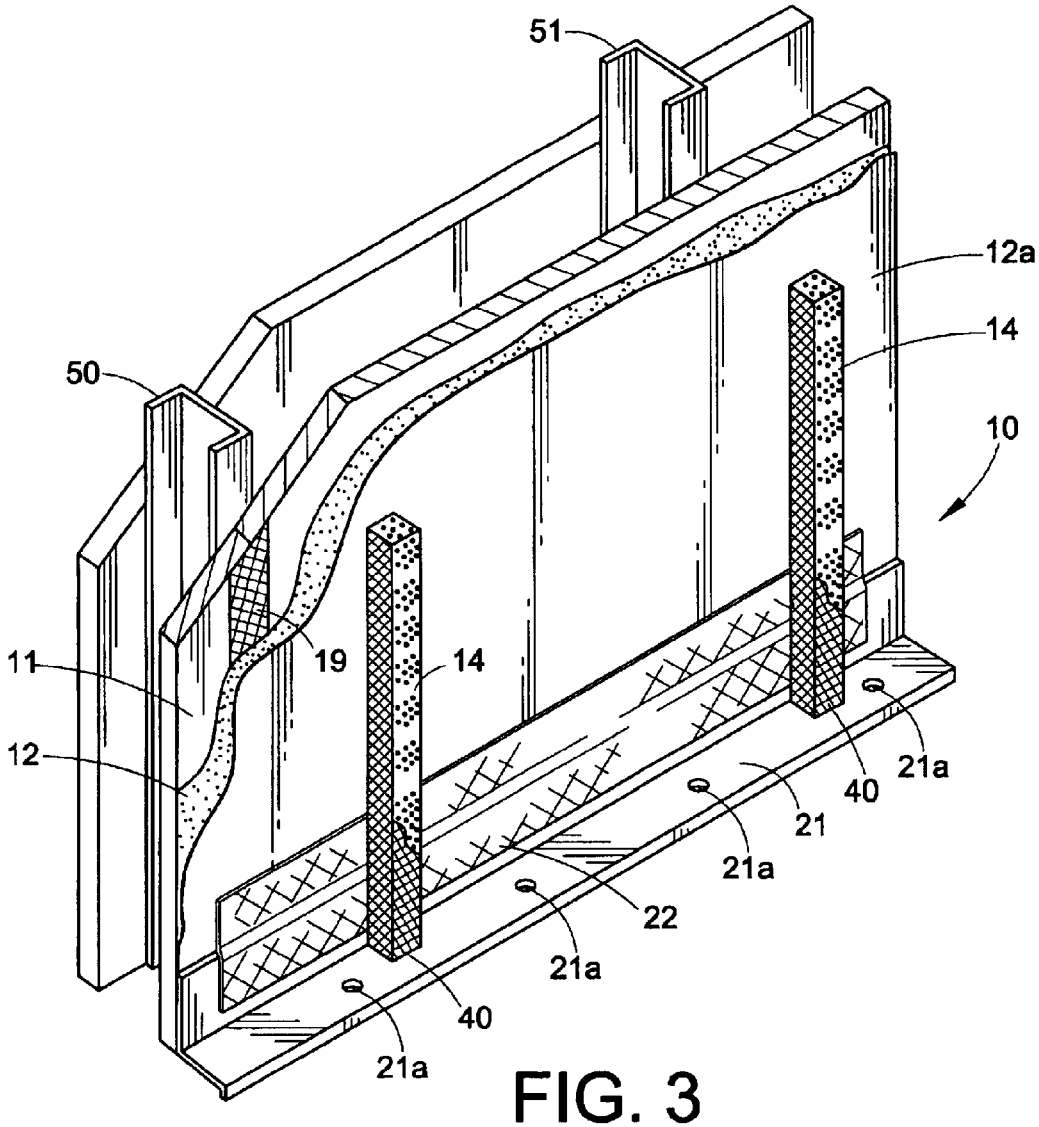
FIGS. 3 and 3A are cut away perspective views of a space for receiving a cavity forming means, the space being formed from a air/weather barrier-coated inner member and at least two spaced closure members.
Figure 3A:
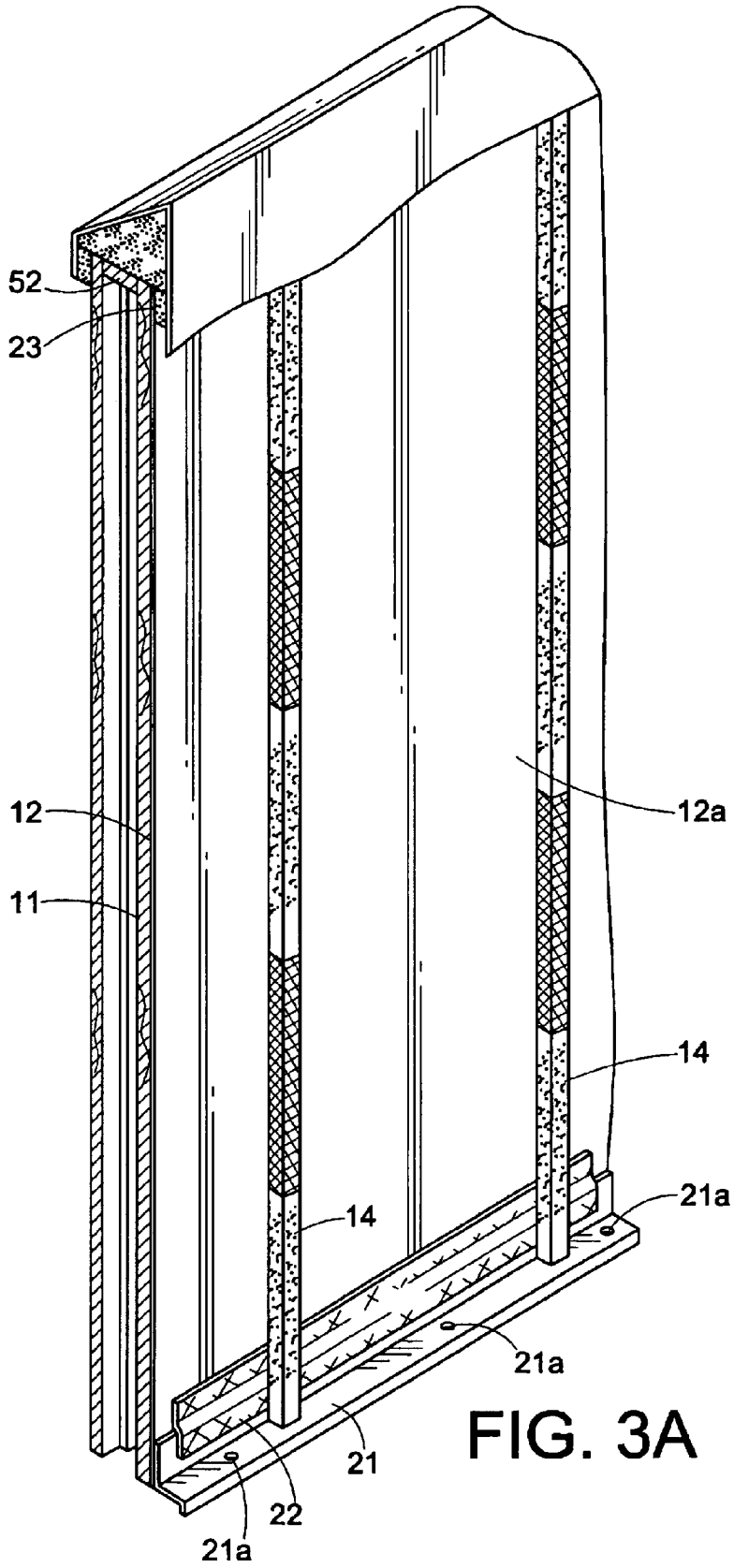

With reference to FIGS. 3 and 3A, once the starter track 21 is sealed, the closure members 14 are positioned and applied onto the air/weather barrier 12 of the inner member 11 of the system 10, thus forming the outer edges of a compartment, defining a space. The specific placement of the closure members 14 along the length of the air/weather barrier 12 may vary depending on the design of each project. With reference to FIG. 3A, the starter track 21 is mounted along the bottom edge of the system and extends along substantially the entire length of the bottom edge of the inner member 11. A closure member 23 extending horizontally along the top edge of inner member 11 defines the upper wall of the compartment. A plurality of closure members 14 are positioned vertically on inner membrane 11 and extend from the bottom edge of the inner member 11 to the horizontally disposed closure member 23 located at the top edge of inner member 11.

After the closure members 14 have been applied to the air/weather barrier 12 to form the compartment, the inner and outer edges of the closure members 14 are sealed with an air barrier 40. As described hereinabove, the air barrier is preferably a roller-, brush- or trowel-applied coating that reduce the infiltration of air. Once formed by the closure members 14, the compartment has a depth sufficient to receive a cavity forming means 15 and the outer insulating member 13.

Figure 4:
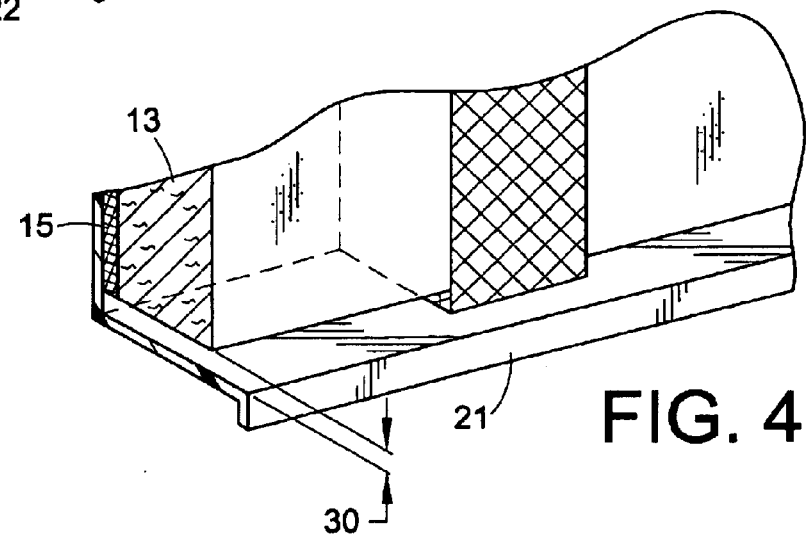
FIG. 4 is an enlarged cut-away perspective view of the vent space of the pressure equalizing compartment of the present invention.
Figure 5:
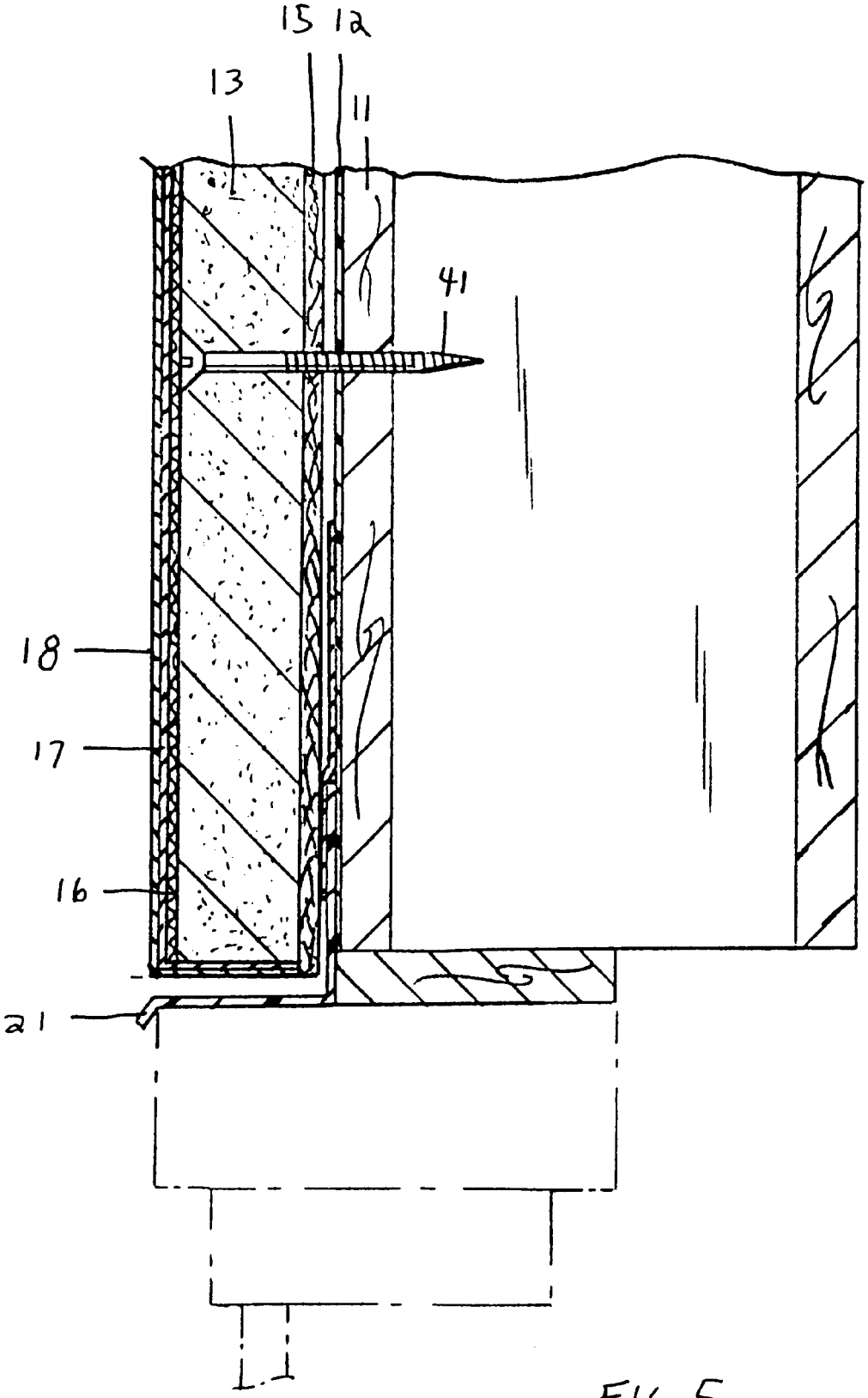
FIG. 5 is a cross-sectional side view of the pressure equalized building wall system of the present invention.

With reference to FIGS. 1 and 5, a cavity forming means 15 is positioned on the outer surface of inner member 11 within the space defined by the closure members. The cavity forming means is positioned on the outer surface of the inner member 11 such that portions of the cavity forming means are in contact with the air/weather barrier 12 disposed on the outer surface of inner member 11. The cavity forming means is preferably a polymeric drainage mat and, as described above, is formed of fused and entangled plastic or polymeric filaments. With reference to FIG. 4, a vent area is preferably provided by positioning the cavity-forming mat 15 within the compartment so that a space 30 is present between the bottom edge of the mat 15 and the top edge of the starter track 21. In an alternative embodiment, the starter track 21 can be provided with a plurality of holes 21*a* to provide a vent that communicates to the outside environment.

The outer insulating member 13 is positioned over the mat 15 within the compartment and securely mounted to the inner membrane be means of a mechanical device 41. The length and width of the outer insulating member 13 is cut be substantially equivalent to in the inner dimensions of the compartment formed by the closure members, such that the outer insulating member 13 can be fitted into the compartment.

With reference to FIG. 5, after the outer insulating member 13 is secured to the inner member 11, an exterior finish is applied to the outer surface of the outer insulating member 13 and closure members 14. The exterior finish comprises a reinforcing mesh layer 17, a base coat 16 and a finish coat 18. The base coat 16 is applied directly to the outer surface of the outer insulating member 13. The reinforcing mesh 17 is applied to and embedded in the base coat 16. Once the base coat 16 has dried, the exterior finish coat 18 is applied over the base dried base coat 16 to provide an aesthetically pleasing exterior finished surface.

The present invention also provides a building wall structure comprising the pressure equalizing exterior insulation and finish system of the present invention. More particularly, the invention provides a building wall system including a substrate and at least one pressure equalized compartment. One of the suggested environments for pressure equalizing compartment is in conjunction with the construction of an external wall of a building. In a preferred embodiment, the wall is of a typical 2×4 frame construction, although other construction techniques and configurations are equally suitable environments for the pressure equalized exterior insulation and finish system of the present invention.

The building wall is generally constructed of a frame, a sheathing, and an external wall covering. The frame typically includes a plurality of studs 50, 51, which are members of wood or steel having, in one preferred embodiment, nominal dimensions of 2"×4". The studs 50, 51 are vertically oriented and are parallel and spaced apart a distance of typically 16" or 24", although these dimensions and parameters are subject to change in response to new building codes and additional advances in the relevant art. The studs 50, 51 are each typically fixedly attached at an upper end to a plate 52, with the plate 52 typically being a member of similar dimension to the studs 50, 51 fand oriented horizontally such that multiple vertical studs in a wall are fixedly attached to a single plate. The studs 50, 51 are usually fixedly attached to plate 52 by means of mechanical fasteners such as nails and/or screws. Moreover, the studs are each typically attached to a sill plate which is of a similar configuration to plate 52.

The frame additionally contains an interior surface which faces toward the living area and an exterior surface which faces toward the outside environment. As is well known in the relevant art, a layer of sheathing material is typically fixedly attached to exterior surface. The sheathing (i.e.-inner member) is typically a sheet of material such as gypsum board or any of a variety of other materials. While the installation of sheathing might be optional in some circumstances, such circumstances will typically be dictated by applicable building codes. The sheathing is typically attached to the exterior surface by mechanical fasteners such as screws, nails, staples, and the like, and may likewise be fastened with materials such as adhesives, all of which are well known in the relevant art.

The outer surface of the sheathing is substantially uniformly coated with an air/weather barrier, as described hereinabove. Closure members are applied to the coated surface of the sheathing and are allowed to dry, thus forming a space between the spaced apart closure members.

According to the present invention, a cavity-forming polymeric mat is then installed onto sheathing within the space defined between the closure members. The polymeric mat is fixedly attached to the outer surface of the coated inner member using any of a variety of fastening systems such as mechanical fasteners like screws, nails, staples, adhesives and the like. While a variety of attachment systems may be used to attach the polymeric mat to the outer surface of the inner member, it is preferred that such attachment systems create a minimum of holes and/or voids in the air/weather barrier, and are of sufficient strength to retain the polymeric mat in place until the outer insulation member and external wall covering is installed.

Once the polymeric mat has been attached to the inner member, the outer member is installed over the mat, within the space defined between the spaced apart closure members. The external finish is then applied to the outer surface of the outer member. In one preferred embodiment, the outer member is an insulation board and the exterior finish comprises an exterior insulation and finish system (EIFS). The EIFS is well known and understood in the relevant art, and is sometimes referred to as "synthetic stucco", as it has largely replaced the conventional stucco system employing lath and stucco plaster. While, in the preferred embodiment, the external wall covering is to be an EIFS, it should be understood that any of a great variety of materials such as brick, vinyl or aluminum siding, wood, and the like can be used without departing from the spirit of the present invention.

It is widely known that exterior insulation and finish systems are comprised of an insulating substrate such as an insulation board, reinforcing mesh, base coats and finish coats, all of which are well known and understood in the relevant art. The insulating substrate is typically a sheet of stiff, low density material such as polystyrene, although other materials may be used. Reinforcing mesh is typically a mesh of high-tensile fibers such as fiberglass mesh, although other materials could be used without departing from the spirit of the present invention.

The exterior finish system is installed by first fixedly attaching outer insulating member directly over the polymeric mat using any of a variety of appropriate attachment systems such as nails, staples, or screws, although appropriate adhesives may be used without departing from the spirit of the present invention. Nevertheless, if adhesives are used, they must be applied in such quantity to not interfere with the ability of the mat to carry and transport gases and fluids therethrough.

If nails or other appropriate fasteners such as staples, are used to attach the outer insulating member to the first substrate, the nails or staples are preferably driven through the polymeric mat and first substrate into studs and/or header in order to provide a sufficient anchoring system. It is additionally preferred that the nails or staples be driven into the inner member if it is of a material which can effectively accept fasteners, such as plywood.

In the circumstance involving nailing, nails may cause the outer insulating member to be urged toward inner member with the polymeric drainage mat compressed therebetween. The polymeric mat comprises an open, three-dimensional matrix of irregularly looped and intermingled plastic filaments and are self-bonded at random points of intersection. As is indicated hereinbefore, the polymeric drainage mat possesses a crush-resistant character which allows it to withstand a certain level of compressive force without interfering with the free flow of liquids and gases therethrough. As such, the mat must be configured to withstand the compressive force of the insulating substrate as urged toward the first substrate by an appropriate number of nails.

Once the outer insulating member is fixedly attached to the structure, the reinforcing mesh is installed onto the outer insulating member using a binder. A binder is a material well known and understood in the relevant art having both adhesive and structural properties. The binder may supplied in a dry, semi-liquid or paste form which, when hardens, fixedly attaches the reinforcing mesh to the insulating substrate and provides external wall covering with a substantial stiffness and rigidity.

As is well known and understood in the relevant art, the reinforcing mesh is installed onto the insulating substrate by first applying a thin coat of base coat or binder onto the insulating substrate and then laying the reinforcing mesh into the uncured base coat. Before the coating of the base coat has cured or dried, the base coat is forced through voids in the reinforcing mesh. As a result, the reinforcing mesh becomes embedded in the base coat. Once the base coat is cured, a finish coat is applied thereto and allowed to dry.

The placement of the polymeric mat between the air barrier-coated inner member and the outer insulating member creates a cavity to permit the ventilation of gases and water between external wall covering and the first substrate, thereby preventing moisture from remaining trapped therebetween by allowing any such moisture to flow through the mat to appropriate vents constructed in the lower end of the pressure equalized system.

Accordingly, the improved pressure equalized system for building structures is simplified, and provides an effective, safe, inexpensive, efficient system to substantially prevent the passage of wind and water from the exterior environment into the building wall.

The pressure equalized cladding system of the present invention provides a compartmentalized cavity/drainage layer between the interior member and the outer insulating substrate, such that the pressure in the cavity is substantially the same as the pressure of the outside atmosphere. Without being bound to any particular theory, under these conditions, it is believed that there will be insufficient pressure differential to force water into the wall assembly.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Based on the foregoing disclosure, it is therefore demonstrated that the objects of the present invention are accomplished by the pressure equalized compartment system, pressure equalizing exterior insulation and finish system, pressure equalized building wall and processes for installation described. It should be understood that the selection of specific substrates, adhesives, fasteners, can be utilized in the systems of the present invention, and can be determined by one having ordinary skill in the art without departing from the spirit of the invention herein disclosed and described. It should therefore be appreciated that the present invention is not limited to the specific embodiments described above, but includes variations, modifications and equivalent embodiments defined by the following claims.

I claim:

1. A pressure equalizing compartment for a building structure having a frame comprising:

an inner member attached to the exterior surface of said frame having oppositely facing inner and outer surfaces, said outer surface substantially uniformly coated with an air/weather barrier;

a closure member horizontally disposed on a portion of said outer surface of said inner member;

spaced apart closure members contacting a portion of said outer surface of said inner member and extending vertically along said inner member and in contact with a portion of said horizontally disposed closure member, a space being defined between said vertically spaced closure members and said horizontally disposed closure member;

a drainage cavity forming means disposed in said space defined by said closure members and substantially contacting said air/weather barrier; and an outer insulating member having oppositely facing inner and outer surfaces disposed substantially over said drainage cavity forming means within said space defined by said closure members to form a compartment;

wherein said compartment has an air and moisture vent communicating to the outside environment.

2. The pressure equalizing compartment of claim 1, wherein the inner member is selected from the group consisting of plywood, wafer board, particle board, cement board, gypsum board and concrete block.

3. The pressure equalizing compartment of claim 2, wherein said inner member is gypsum board.

4. The pressure equalizing compartment of claim 2, wherein said inner member is plywood.

5. The pressure equalizing compartment of claim 1, wherein the outer insulating member is a polymeric member.

6. The pressure equalizing compartment of claim 5, wherein the polymeric member is a polystyrene insulation board.

7. The pressure equalizing compartment of claim 1, wherein said spaced closure members are manufactured from a polymeric material.

8. The pressure equalizing compartment of claim 7, wherein said polymeric material is polystyrene.

9. The pressure equalizing compartment of claim 1, wherein said drainage cavity forming means is a three-dimensional mat of plastic filaments.

10. The pressure equalizing compartment of claim 9, wherein said mat comprises an open, three-dimensional matrix of irregularly looped and intermingled plastic filaments and are self-bonded at random points of intersection.

11. The pressure equalizing compartment of claim 10, wherein said plastic filaments are selected from the group consisting of polypropylene, high density polyethylene, polyvinylchloride, polystyrene, polyester and nylon.

12. The pressure equalizing compartment of claim 11, wherein the plastic filaments of said mat are nylon.

13. The pressure equalizing compartment of claim 12, wherein the nylon filaments are nylon 6.

14. The pressure equalizing compartment of claim 1, wherein the closure members have a width of about 3 inches to about 12 inches.

15. A pressure equalizing exterior insulation and finish system for a building structure having a frame comprising:

at least one pressure equalizing compartment comprising:

an inner member attached to the exterior of said frame having oppositely facing inner and outer surfaces, said outer surface substantially uniformly coated with an air/weather barrier;

a closure member horizontally disposed on a portion of said outer surface of said inner member;

spaced apart closure members contacting a portion of said outer surface of said inner member and extending vertically along said inner member and in contact with a portion of said horizontally disposed closure members, a space being defined between said vertically spaced closure members and said horizontally disposed closure member;

a drainage cavity forming means disposed in said space defined by said closure members and substantially contacting said air/weather barrier;

an outer insulating member having oppositely facing inner and outer surfaces disposed substantially over said drainage cavity forming means within said space defined by said closure members to form a compartment; wherein said compartment has an air and moisture vent communicating to the outside environment; and an exterior finish applied to said outer surface of said outer insulating member.

16. The pressure equalizing exterior insulation and finish system of claim 15, wherein the inner member is selected from the group consisting of plywood, wafer board, particle board, cement board, gypsum board and concrete block.

17. The pressure equalizing exterior insulation and finish system of claim 16, wherein said inner member is gypsum board.

18. The pressure equalizing exterior insulation and finish system of claim 16, wherein said inner member is plywood.

19. The pressure equalizing exterior insulation and finish system of claim 15, wherein the outer insulating member is a polymeric member.

20. The pressure equalizing exterior insulation and finish system of claim 19, wherein the polymeric member is a polystyrene insulation board.

21. The pressure equalizing exterior insulation and finish system of claim 15, wherein said spaced closure members are manufactured from a polymeric material.

22. The pressure equalizing exterior insulation and finish system of claim 21, wherein said polymeric material is polystyrene.

23. The pressure equalizing exterior insulation and finish system of claim 15, wherein said drainage cavity forming means is a three-dimensional mat of plastic filaments.

24. The pressure equalizing exterior insulation and finish system of claim 23, wherein said mat comprises an open, three-dimensional matrix of irregularly looped and intermingled plastic filaments and are self-bonded at random points of intersection.

25. The pressure equalizing exterior insulation and finish system of claim 24, wherein said plastic filaments are selected from the group consisting of polypropylene, high density polyethylene, polyvinylchloride, polystyrene, polyester and nylon.

26. The pressure equalizing exterior insulation and finish system of claim 25, wherein the plastic filaments of said mat are nylon.

27. The pressure equalizing exterior insulation and finish system of claim 26, wherein the nylon filaments are nylon 6.

28. The pressure equalizing exterior insulation and finish system of claim 15, wherein the closure members have a width of about 3 inches to about 12 inches.

29. The pressure equalizing exterior insulation and finish system 15, wherein the exterior finish comprises:

a reinforcing mesh;

a base coat; and a finish coat applied to said base coat.

30. The pressure equalizing exterior insulation and finish system of claim 29, wherein the reinforcing mesh is substantially embedded in said base coat.

31. The pressure equalizing exterior insulation and finish system of claim 29, wherein the reinforcing mesh is a glass fiber mesh.

32. The pressure equalizing exterior insulation and finish system of claim 29, wherein system comprises fastening means to fasten said reinforcing mesh to said outer insulating member.

33. The pressure equalizing exterior insulation and finish system of claim 32, wherein the fastening means is selected from the group consisting of nails, screws, staples, tacks, rivets and adhesives.

34. The pressure equalizing exterior insulation and finish system of claim 33, wherein the fastening means are nails.

35. The pressure equalizing exterior insulation and finish system of claim 33, wherein the fastening means are staples.

36. A pressure equalized building wall comprising:

a frame having an interior surface and an exterior surface;

an inner member having oppositely facing inner and outer surfaces and having top and bottom edges, wherein said inner member is attached to the exterior surface of said frame;

an air/weather barrier having opposite facing inner and outer surfaces, wherein said inner surfaces is in contact with said outer surface of said inner member;

a closure member horizontally disposed on a portion of said outer surface of said air/weather barrier;

spaced apart closure members contacting said outer surface of said air/weather barrier and extending vertically along said air/weather barrier and in contact with a portion of said horizontally disposed closure member, a space being defined between said vertically spaced closure members and said horizontally disposed closure member;

a drainage cavity forming means disposed in said space defined by said closure members and substantially contacting said air/weather barrier; and an outer insulating member having oppositely facing inner and outer surfaces disposed substantially over said drainage cavity forming means within said space defined by said closure members to form a compartment;

wherein said compartment has an air and moisture vent communicating to the outside environment.

37. The pressure equalized building wall of claim 36, wherein the inner member is selected from the group consisting of plywood, wafer board, particle board, cement board, gypsum board and concrete block.

38. The pressure equalized building wall of claim 37, wherein said inner member is gypsum board.

39. The pressure equalized building wall of claim 37, wherein said inner member is plywood.

40. The pressure equalized building wall of claim 36, wherein the outer insulating member is a polymeric member.

41. The pressure equalized building wall of claim 40, wherein the polymeric member is a polystyrene insulation board.

42. The pressure equalized building wall of claim 36, wherein said spaced closure members are manufactured from a polymeric material.

43. The pressure equalized building wall of claim 42, wherein said polymeric material is polystyrene.

44. The pressure equalized building wall of claim 36, wherein said drainage cavity forming means is a three-dimensional mat of plastic filaments.

45. The pressure equalized building wall of claim 44, wherein said mat comprises an open, three-dimensional matrix of irregularly looped and intermingled plastic filaments and are self-bonded at random points of intersection.

46. The pressure equalized building wall of claim 45, wherein said plastic filaments are selected from the group consisting of polypropylene, high density polyethylene, polyvinylchloride, polystyrene, polyester and nylon.

47. The pressure equalized building wall of claim 46, wherein the plastic filaments of said mat are nylon.

48. The pressure equalized building wall of claim 47, wherein the nylon filaments are nylon 6.

49. The pressure equalized building wall of claim 36, wherein the closure members have a width of about 3 inches to about 12 inches.

50. The pressure equalized building wall of claim 36, wherein an exterior finish is applied to said outer surface of said outer insulating member.

51. The pressure equalized building wall 50, wherein the exterior finish comprises:

a reinforcing mesh;

a base coat; and a finish coat applied to said base coat.

52. The pressure equalized building wall of claim 51, wherein the reinforcing mesh is substantially embedded in said base coat.

53. The pressure equalized building wall of claim 51, wherein the reinforcing mesh is a glass fiber mesh.

54. The pressure equalized building wall of claim 36, wherein system comprises fastening means to fasten said reinforcing mesh to said outer insulating member.

55. The pressure equalized building wall of claim 54, wherein the fastening means is selected from the group consisting of nails, screws, staples, tacks, rivets and adhesives.

56. The pressure equalized building wall of claim 55, wherein the fastening means are nails.

57. The pressure equalized building wall of claim 55, wherein the fastening means are staples.

58. A process for installing a pressure equalized building wall comprising:

attaching an inner member having oppositely facing inner and outer surfaces to the exterior surface of a frame;

applying an air/weather barrier substantially uniformly over the outer surface of said inner member;

attaching a closure member on said outer surface of said air/weather barrier in a substantially horizontal direction;

attaching spaced apart closure members to said outer surface of said air/weather barrier, wherein said spaced apart closure members are extending vertically along said air/weather barrier and in contact with a portion of said horizontally disposed closure member, a space being defined between said vertically spaced closure members and said horizontally disposed closure member;

disposing a drainage cavity forming means on the outer surface of the air/weather barrier within the spaced defined between said closure members; and disposing an outer insulating member having an inner surface and an outer surface substantially over the drainage cavity forming means within the space between said closure members.

59. The method of claim 58, further comprising applying an exterior finish to the outer surface of the outer insulating member.

* * * * *